US006283046B1

(12) United States Patent
Tseng

(10) Patent No.: US 6,283,046 B1
(45) Date of Patent: Sep. 4, 2001

(54) FURNITURE WITH FOLDABLE LEG MEMBERS

(76) Inventor: Chun-Hsien Tseng, No. 3, Ting-Hsi Hsin, Lu-Man Tsun, Chu-Chi Hsiang, Chiayi Hsien (TW)

( * ) Notice: Subject to any disclaimer, the term of this patent is extended or adjusted under 35 U.S.C. 154(b) by 0 days.

(21) Appl. No.: 09/550,127

(22) Filed: Apr. 17, 2000

(51) Int. Cl.[7] ..... A47B 3/00
(52) U.S. Cl. ..... 108/127; 297/54
(58) Field of Search ..... 108/124, 127, 108/131, 132, 133; 248/166, 168, 170, 171, 292.13; 297/440.24, 54, 16.1

(56) References Cited

U.S. PATENT DOCUMENTS 3,033,614 * 5/1962 Pazan ..... 297/16.1 X
5,259,305 * 11/1993 Korb ..... 108/132 X
5,367,962 * 11/1994 Tseng ..... 108/127

* cited by examiner

*Primary Examiner*—Janet M. Wilkens
(74) *Attorney, Agent, or Firm*—Harness, Dickey & Pierce, P.L.C.

(57) ABSTRACT

A piece of furniture includes a body portion, a plurality of leg members, a plurality of sleeve members, and a plurality of spring members. The body portion has a bottom side, and a plurality of projections projecting downwardly from the bottom side. Each of the leg members has an upper end connected pivotally to a distal end of a corresponding one of the projections to form a pivot joint. Each of the sleeve members is sleeved movably on the pivot joint that includes the distal end of a corresponding one of the projections and the upper end of a corresponding one of the leg members. Each of the spring members is mounted on a corresponding one of the leg members for biasing and retaining a corresponding one of the sleeve members around the pivot joint that includes the distal end of the corresponding one of the projections and the upper end of the corresponding one of the leg members, thereby preventing the leg members from turning relative to the projections.

3 Claims, 5 Drawing Sheets

FURNITURE WITH FOLDABLE LEG MEMBERS

BACKGROUND OF THE INVENTION

1. Field of the Invention

This invention relates to a piece of furniture, more particularly to a piece of furniture having foldable leg members.

2. Description of the Related Art

Pieces of furniture, such as tables, chairs, beds, desks, etc., are widely used in a house, room, office, etc. Since residential spaces are relatively small nowadays, it is desirable to reduce the storage and transport volume of furniture.

SUMMARY OF THE INVENTION

The object of the present invention is to provide a piece of furniture that is provided a plurality of foldable leg members in order to reduce the storage and transport volume of the furniture.

According to the present invention, a piece of furniture includes a body portion, a plurality of leg members, a plurality of sleeve members, and a plurality of spring members. The body portion has a bottom side, and a plurality of projections projecting downwardly from the bottom side. Each of the leg members has an upper end connected pivotally to a distal end of a corresponding one of the projections to form a pivot joint. Each of the sleeve members is sleeved movably on the pivot joint that includes the distal end of a corresponding one of the projections and the upper end of a corresponding one of the leg members. Each of the spring members is mounted on a corresponding one of the leg members for biasing and retaining a corresponding one of the sleeve members around the pivot joint that includes the distal end of the corresponding one of the projections and the upper end of the corresponding one of the leg members, thereby preventing the leg members from turning relative to the projections.

In the preferred embodiment, each of the leg members is formed as a generally V-shaped rod that has a lower angled portion, two arm portions extending divergently from the lower angled portion, and two extension portions. Each of the extension portions extends upwardly from a distal end of a corresponding one of the arm portions, and is connected pivotally to the distal end of the corresponding one of the projections.

Preferably, each of the leg members has an abutting flange extending radially and outwardly therefrom between the corresponding one of the extension portions and the corresponding one of the arm portions. Each of the spring members is formed as a coil spring that is sleeved around the corresponding one of the extension portions and that is seated on the abutting flange of the corresponding one of the extension portions.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
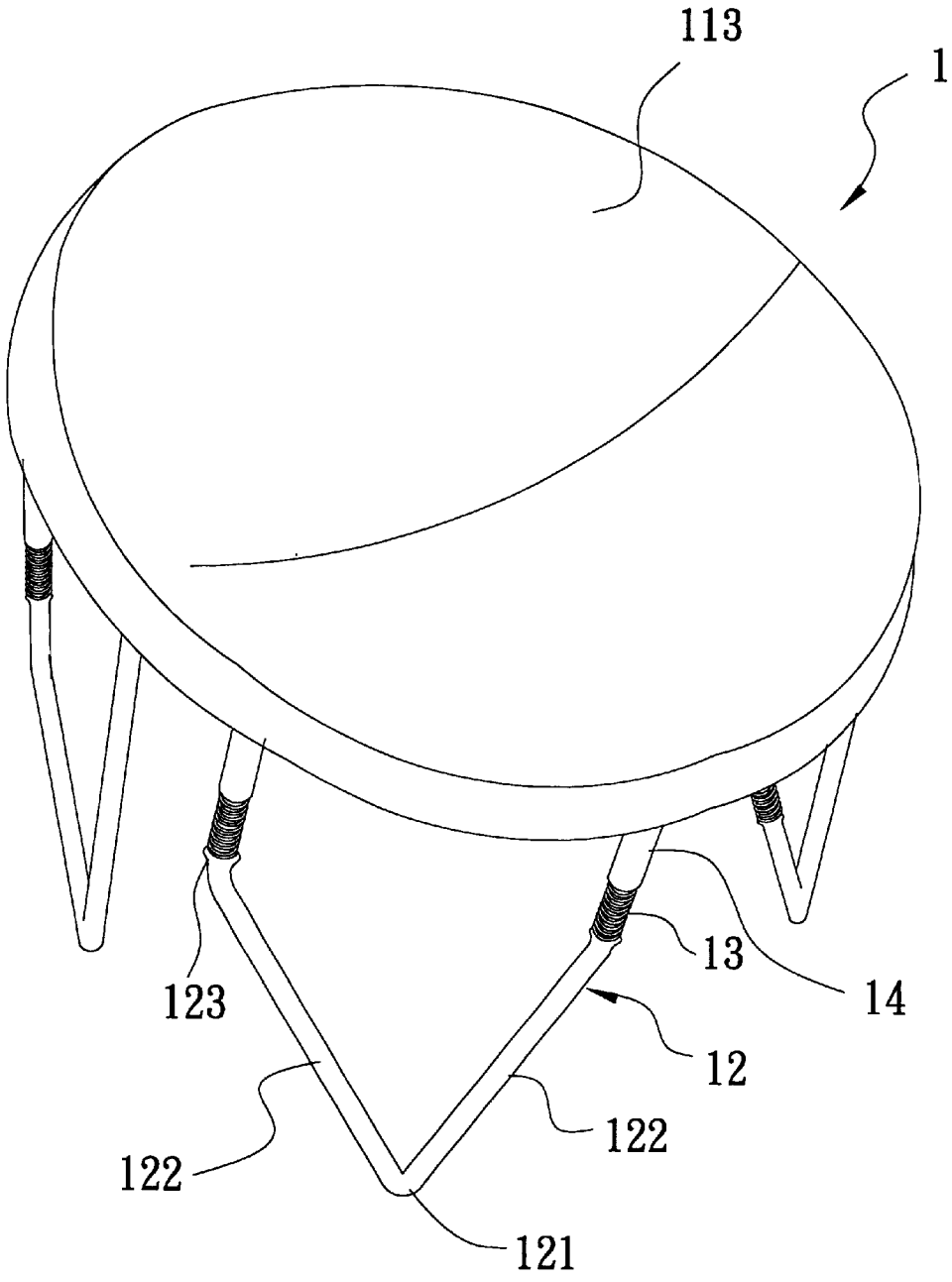
FIG. 1 is a perspective view of a preferred embodiment of a piece of furniture according to the present invention.
Figure 2:
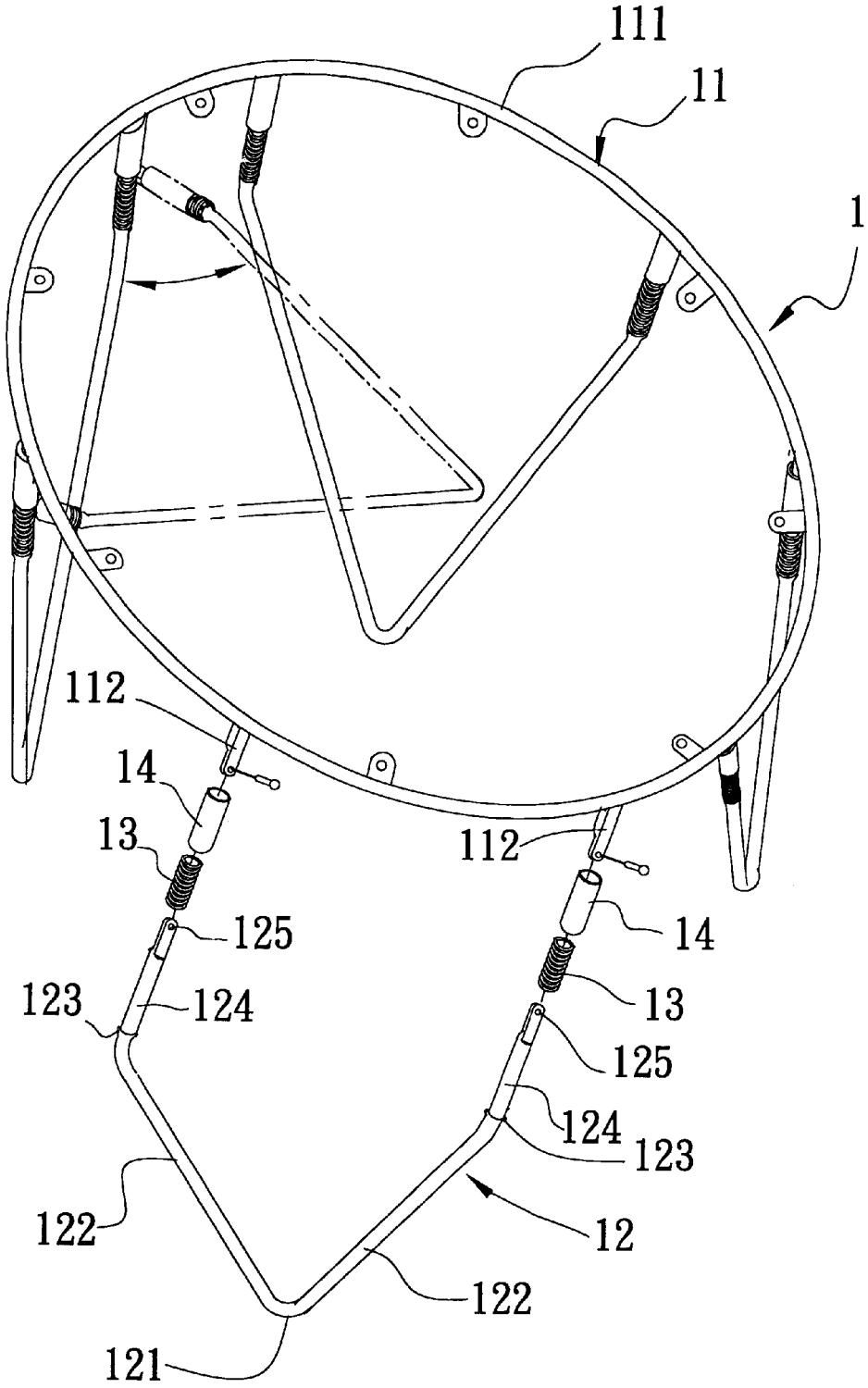
FIG. 2 is a partly exploded perspective view of the preferred embodiment of the furniture according to the present invention.

Referring to FIGS. 1 and 2, a piece of furniture of the present invention is embodied by a chair, generally designated by 1, which includes a body portion 11, four leg members 12, eight sleeve members 14, and eight spring members 13.

As shown, the body portion 11 has a circular frame 111, a plurality of projections 112 projecting downwardly from a bottom side of the frame 111, and a cloth member 113 mounted on the frame 111.

Figure 3:
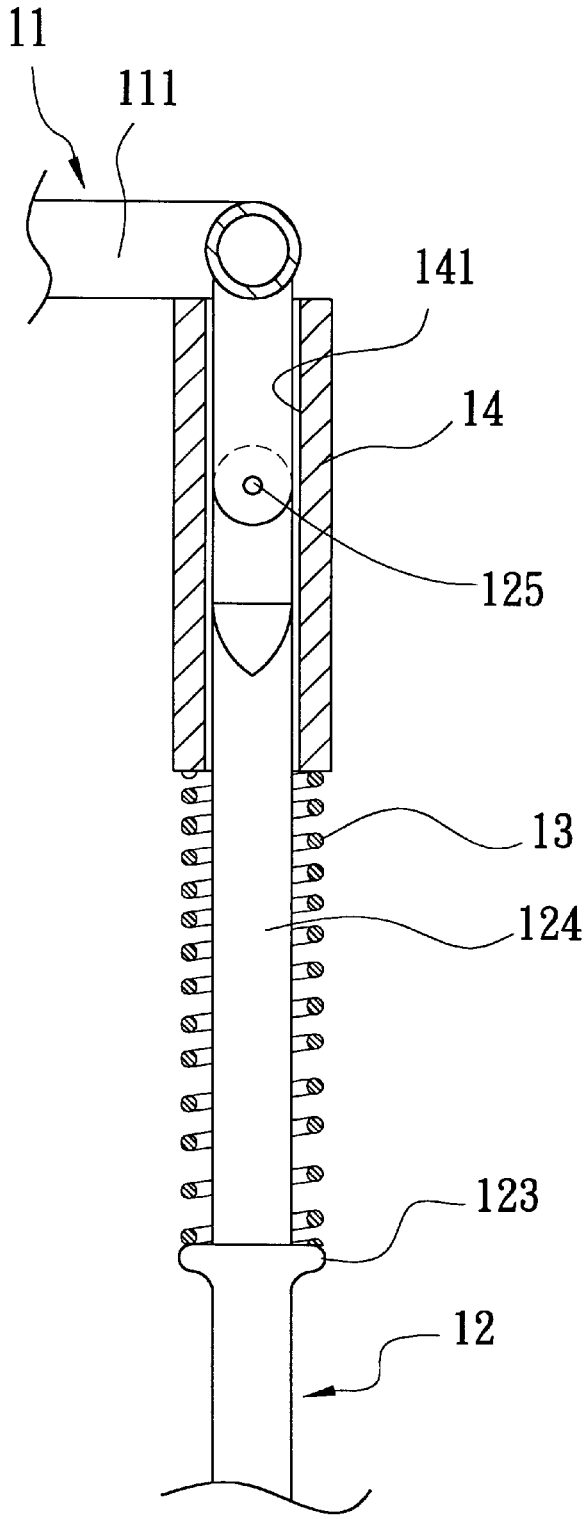
FIG. 3 is a fragmentary cross sectional view illustrating a pivot joint of a leg member of the preferred embodiment of the furniture according to the present invention.

Referring to FIGS. 1 and 2, in combination with FIG. 3, each of the leg members 12 is formed as a generally V-shaped metal rod that has a lower angled portion 121, two arm portions 122 extending divergently from the lower angled portion 121 that is adapted to be disposed on the ground, and two extension portions 124. Each of the extension portions 124 extends upwardly from a distal end of a corresponding one of the arm portions 122, and is connected pivotally to a distal end of the corresponding one of the projections 112 to form a pivot joint 125. Each of the leg members 12 has an abutting flange 123 extending radially and outwardly therefrom between a corresponding one of the extension portions 124 and a corresponding one of the arm portions 122.

Each of the sleeve members 14 is made of a metal material and has an axial hole 141 formed therethrough. Each of the sleeve members 14 is sleeved movably on a respective pivot joint 125, which includes the distal end of a corresponding one of the projections 112 and the upper end of a corresponding one of the leg members 12.

Each of the spring members 13 is mounted on a corresponding one of the leg members 12 for biasing and retaining a corresponding one of the sleeve members 14 around the respective pivot joint 125, which includes the distal end of the corresponding one of the projections 112 and the upper end of the corresponding one of the leg members 12. Specifically, each of the spring members 13 is formed as a coil spring that is sleeved around the corresponding one of the extension portions 124 and that is seated on the abutting flange 123 of the corresponding one of the extension portions 124. As such, the leg members 12 can be prevented from turning relative to the projections 112.

When a load is applied on the chair 1, the sleeve members 14 are depressed downwardly against the spring action of the spring members 13 and are retained around the pivot joints 125. In this position, the leg members 12 are prevented from turning relative to the body portion 11. As such, the leg members 12 can stand on the ground in a stable manner.

Figure 4:
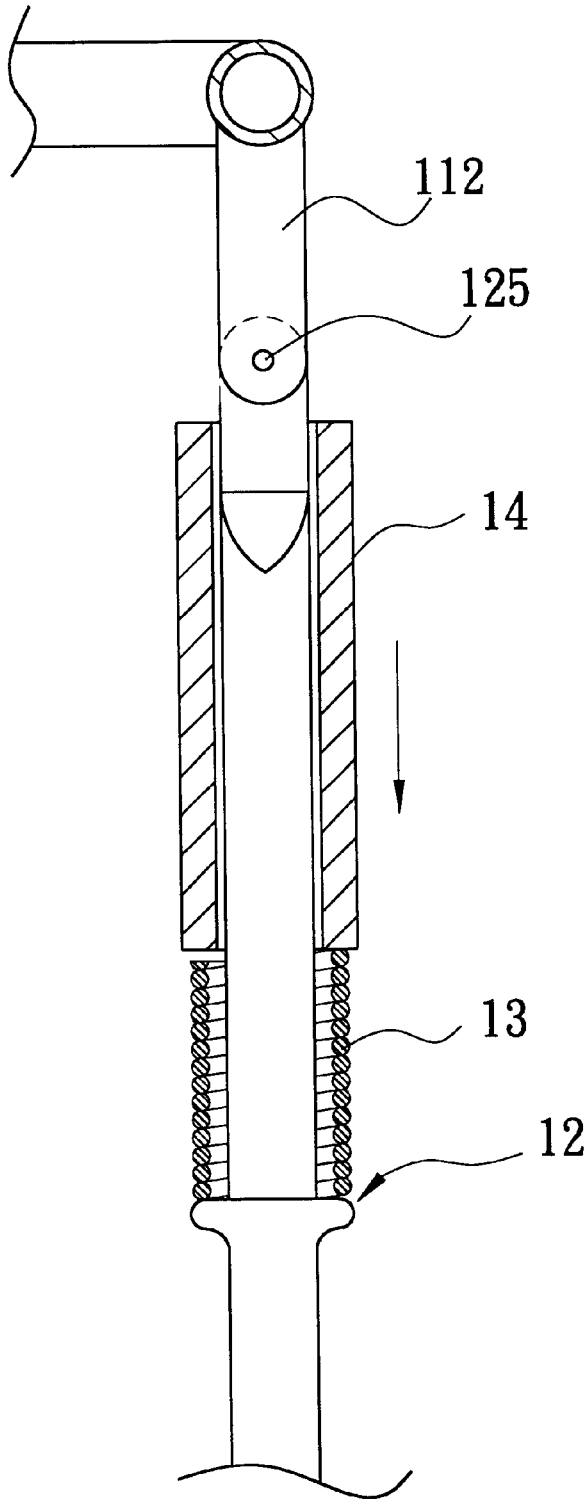
FIG. 4 is a view similar to that of FIG. 3, illustrating a downward movement of a sleeve member of the preferred embodiment of the furniture according to the present invention.
Figure 5:
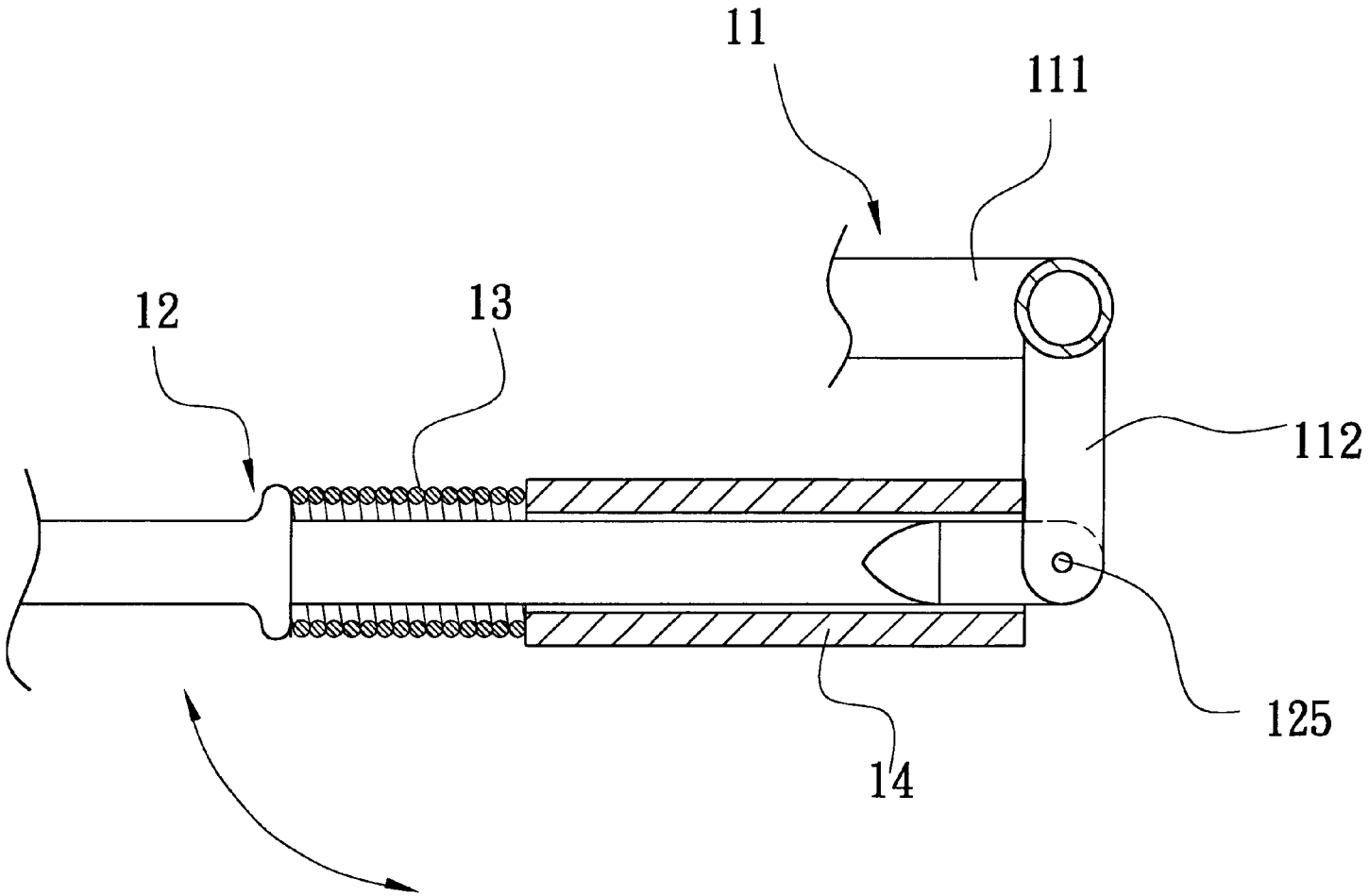
FIG. 5 is a view similar to that of FIG. 3, illustrating the pivotal movement of the leg member the preferred embodiment of the furniture of according to the present invention.

Referring to FIGS. 4 and 5, when it is desired to fold the leg members 12, the sleeve member 14 on one of the leg members 12 is gripped and pushed downwardly against the biasing action of the corresponding one of the spring members 13 until the corresponding one of the pivot joints 125 is exposed from and is not restrained by the sleeve member 14. At this time, the leg member 12 can be turned toward the bottom side of the body portion 11 about the pivot joint 125 while the spring member 13 abuts against the pivot joint

125. The rest of the leg members 12 can be folded in the same manner as described hereinabove. When the leg members 12 are in the folded position, since the leg members 12 are substantially perpendicularly to the projections 112, and since the sleeve members 14 abut against the pivot joints 125 by the spring action of the spring members 13, the leg members 12 can be prevented from turning away from the body portion 11 to an unfolded position.

When it is desired to unfold the leg members 12, the sleeve member 14 on one of the leg members 12 is gripped and moved the sleeve member 14 in order to disengage the sleeve member 14 from the corresponding one of the pivot joints 125. At this time, the leg member 12 can turn away from the body portion 11 to the unfolded position. The rest of the leg members 12 can be unfolded in the same manner as described hereinbefore.

As described above, the leg members 12 can be folded hands without the need for using tools. When the leg members 12 are folded, the volume of the furniture 1 is dramatically reduced. As such, the furniture 1 can be stored and transported with a minimal space requirement.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A piece of furniture comprising:

a body portion having a bottom side, and a plurality of projections that project downwardly from said bottom side, each of said projections having a distal end;

a plurality of leg members, each having an upper end connected pivotally to said distal end of a corresponding one of said projections to form a pivot joint;

a plurality of sleeve members, each being sleeved movably on said pivot joint that includes said distal end of a corresponding one of said projections and said upper end of a corresponding one of said leg members; and a plurality of spring members, each being mounted on a corresponding one of said leg members for biasing and retaining a corresponding one of said sleeve members around said pivot joint that includes said distal end of the corresponding one of said projections and said upper end of the corresponding one of said leg members, thereby preventing said leg members from turning relative to said projections.

2. The piece of furniture as claimed in claim 1, wherein each of said leg members is formed as a generally V-shaped rod that has a lower angled portion, two arm portions extending divergently from said lower angled portion, and two extension portions, each of said extension portions extending upwardly from a distal end of a corresponding one of said arm portions and being connected pivotally to said distal end of the corresponding one of said projections.

3. The piece of furniture as claimed in claim 2, wherein each of said leg members has an abutting flange extending radially and outwardly therefrom between the corresponding one of said extension portions and the corresponding one of said arm portions, each of said spring members being formed as a coil spring that is sleeved around the corresponding one of said extension portions and that is seated on said abutting flange of the corresponding one of said extension portions.

* * * * *